US011846190B2

(12) United States Patent
Lugg et al.

(10) Patent No.: US 11,846,190 B2
(45) **Date of Patent: *Dec. 19, 2023**

(54) ROCK CUTTING DEVICE

(71) Applicant: Joy Global Underground Mining LLC, Warrendale, PA (US)

(72) Inventors: Peter A. Lugg, Ferny Grove (AU); Geoffrey W. Keech, Wellington Point (AU)

(73) Assignee: JOY GLOBAL UNDERGROUND MINING LLC, Warrendale, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/667,479

(22) Filed: Oct. 29, 2019

(65) Prior Publication Data

US 2020/0063554 A1 Feb. 27, 2020

Related U.S. Application Data

(63) Continuation of application No. 15/712,428, filed on Sep. 22, 2017, now Pat. No. 10,533,416.

(Continued)

(51) Int. Cl.

*E21C 25/18* (2006.01)
*E21C 35/06* (2006.01)

(Continued)

(52) U.S. Cl.

CPC ..... *E21C 35/06* (2013.01); *E21B 44/02* (2013.01); *E21C 25/18* (2013.01); *E21C 25/68* (2013.01); *E21C 29/22* (2013.01); *E21C 31/08* (2013.01); *E21C 35/00* (2013.01); *E21D 9/102* (2013.01); *E21D 9/1046* (2013.01)

(58) Field of Classification Search

CPC ..... E21C 25/18
USPC ..... 299/1.05, 1.4–1.6, 1.8, 36.1, 37.1, 39.1, 299/42, 51, 52, 73–78, 58, 85.1;

(Continued)

(56) References Cited

U.S. PATENT DOCUMENTS 1,093,787 A 4/1914 Kuhn et al.
1,304,352 A 5/1919 Morgan (Continued)

FOREIGN PATENT DOCUMENTS

AU 466244 B1 2/1972
CA 2141984 A1 8/1996

(Continued)

OTHER PUBLICATIONS

International Search Report and Written Opinion for Application No. PCT/US17/52879 dated Dec. 29, 2017 (12 pages).

(Continued)

*Primary Examiner* — Sunil Singh
(74) *Attorney, Agent, or Firm* — Husch Blackwell LLP

(57) ABSTRACT

A rock excavating device includes a shaft and a cutting element. The shaft includes a first portion and a second portion connected to an end of the first portion. The first portion is rotatable about a first axis. The second portion extends along a second axis that is oblique with respect to the first axis. The cutting element includes a cutting edge. The cutting element is supported on the second portion and rotatable about the second axis. Rotation of the first portion of the shaft about the first axis changes the orientation of the second axis and the cutting element.

25 Claims, 13 Drawing Sheets

Related U.S. Application Data

(60) Provisional application No. 62/398,717, filed on Sep. 23, 2016, provisional application No. 62/398,834, filed on Sep. 23, 2016, provisional application No. 62/398,744, filed on Sep. 23, 2016.

(51) Int. Cl.

| | |
|---|---|
| *E21D 9/10* | (2006.01) |
| *E21B 44/02* | (2006.01) |
| *E21C 25/68* | (2006.01) |
| *E21C 29/22* | (2006.01) |
| *E21C 31/08* | (2006.01) |
| *E21C 35/00* | (2006.01) |

(58) Field of Classification Search
USPC ..... 175/398, 343, 351, 56; 409/200; 83/647.5
See application file for complete search history.

(56) References Cited

U.S. PATENT DOCUMENTS 1,340,731 A 5/1920 Morgan
1,510,628 A 10/1924 Morgan et al.
1,735,583 A 11/1929 Morgan
1,953,326 A 4/1934 Morgan
2,336,335 A * 12/1943 Zublin ..... E21B 10/22 175/378
2,336,337 A * 12/1943 Zublin ..... E21B 10/18 175/348
2,466,709 A 4/1949 Karr
2,517,267 A 8/1950 Watson
2,619,338 A 11/1952 Lindgren
2,619,339 A 11/1952 Cartlidge
2,654,586 A 10/1953 Berry
2,659,585 A 11/1953 McCallum
2,745,651 A 5/1956 Herrmann
2,756,039 A 7/1956 Barrett
2,776,823 A 1/1957 Barrett
3,157,437 A 11/1964 Gonski
3,197,256 A 7/1965 Hlinsky
3,302,974 A 2/1967 Hlinsky
3,306,663 A 2/1967 Webster
3,353,871 A 11/1967 Arentzen
3,355,215 A 11/1967 Haspert et al.
3,408,109 A 10/1968 Lockwood
3,412,816 A 11/1968 Lautsch
3,446,535 A 5/1969 Lauber
3,647,263 A 3/1972 Lauber et al.
3,663,054 A 5/1972 Dubois
3,729,056 A 4/1973 Paurat
3,719,404 A 6/1973 Sterner
3,840,271 A 10/1974 Sugden
3,922,017 A 11/1975 Cobb
3,929,378 A 12/1975 Frenyo et al.
3,966,258 A 6/1976 Dolecki
3,972,571 A 8/1976 Benkowski
3,995,907 A 12/1976 Dubois
4,005,905 A 2/1977 Dubois
4,087,131 A 5/1978 Peterson et al.
4,096,917 A * 6/1978 Harris ..... E21B 10/083 175/228
4,108,494 A 8/1978 Kogler
4,230,372 A 10/1980 Marten
4,248,481 A 2/1981 Stoltefuss
4,273,383 A 6/1981 Grisebach
4,302,054 A 11/1981 Haskew et al.
4,363,519 A 12/1982 Howard
4,372,403 A * 2/1983 Beeman ..... E21B 10/083 175/343
4,377,311 A 3/1983 Seller
4,470,635 A 9/1984 Paurat et al.
4,516,807 A 5/1985 Eagles
4,548,442 A 10/1985 Sugden et al.
4,589,701 A 5/1986 Beckmann et al.
4,643,483 A 2/1987 Brooks et al.
4,647,112 A 3/1987 Demoulin et al.
4,662,684 A 5/1987 Marten
4,682,819 A 7/1987 Masse
4,741,577 A 5/1988 Sato et al.
4,755,002 A 7/1988 Parrott
4,760,513 A 7/1988 Edwards
4,796,713 A 1/1989 Bechem
4,838,614 A 6/1989 Pentith et al.
4,838,615 A 6/1989 Oldham
4,848,486 A 7/1989 Bodine
4,878,714 A 11/1989 Barnthaler et al.
4,968,098 A 11/1990 Hirsch et al.
5,028,092 A 7/1991 Coski
5,050,934 A 9/1991 Brandl et al.
5,087,102 A 2/1992 Kiefer
5,112,111 A 5/1992 Addington et al.
5,190,353 A 3/1993 Bechem
5,205,612 A 4/1993 Sugden et al.
5,210,997 A 5/1993 Mountcastle, Jr.
5,234,257 A 8/1993 Sugden et al.
5,601,153 A 2/1997 Ensminger et al.
5,676,125 A 10/1997 Kelly et al.
5,697,733 A 12/1997 Marsh
5,938,288 A 8/1999 Saint-Pierre et al.
6,086,257 A 7/2000 Lee
6,561,590 B2 5/2003 Sugden
6,857,706 B2 2/2005 Hames et al.
6,938,702 B2 9/2005 Saha et al.
7,182,407 B1 * 2/2007 Peach ..... E21D 9/1046 299/75
7,325,882 B2 2/2008 Sugden et al.
7,384,104 B2 6/2008 Sugden
7,431,402 B2 * 10/2008 Peach ..... E21D 9/1046 299/75
7,490,911 B2 2/2009 Steinberg et al.
7,695,071 B2 4/2010 Jackson et al.
7,731,298 B2 6/2010 Merten et al.
7,934,776 B2 5/2011 de Andrade et al.
7,954,735 B2 6/2011 Belotserkovsky
8,079,647 B2 12/2011 Yao et al.
8,276,991 B2 10/2012 Thomson
8,328,292 B2 12/2012 de Andrade et al.
8,636,324 B2 1/2014 Skea
8,690,262 B2 4/2014 Ebner et al.
8,727,450 B2 5/2014 de Andrade et al.
9,470,087 B2 10/2016 Smith et al.
10,533,416 B2 * 1/2020 Lugg ..... E21D 9/1046
2002/0093239 A1 * 7/2002 Sugden ..... E21D 9/1046 299/71
2005/0200192 A1 * 9/2005 Sugden ..... E21C 25/16 299/75
2007/0090678 A1 * 4/2007 Peach ..... E21C 25/16 299/72
2007/0193810 A1 8/2007 Steinberg et al.
2008/0156531 A1 7/2008 Boone et al.
2009/0058172 A1 3/2009 DeAndrade et al.
2009/0066148 A1 3/2009 Willison
2009/0127918 A1 5/2009 Yao et al.
2010/0019563 A1 1/2010 Thomson
2010/0260563 A1 10/2010 Conroy et al.
2011/0062768 A1 3/2011 Van Zyl et al.
2011/0181097 A1 7/2011 Skea
2012/0098325 A1 4/2012 Junker et al.
2013/0057044 A1 3/2013 De Andrade et al.
2014/0077578 A1 * 3/2014 Smith ..... E21C 41/16 299/1.4
2014/0091612 A1 4/2014 Rowher
2014/0178155 A1 6/2014 Feasey
2015/0152728 A1 6/2015 Hartwig et al.
2017/0204666 A1 7/2017 Galler et al.
2017/0211383 A1 7/2017 Lugg et al.
2017/0342829 A1 11/2017 De Sousa et al.
2018/0051561 A1 2/2018 Daher et al.

(56) References Cited

U.S. PATENT DOCUMENTS

| | | | |
|---|---|---|---|
| 2018/0051562 | A1 | 2/2018 | Daher et al. |
| 2018/0087379 | A1 | 3/2018 | Lugg et al. |

FOREIGN PATENT DOCUMENTS

| | | | |
|---|---|---|---|
| CL | 35975 | | 2/1988 |
| CL | 199600179 | | 9/1996 |
| CL | 199900483 | | 3/1999 |
| CL | 200901978 | | 2/2010 |
| CN | 101778998 | A | 7/2010 |
| CN | 101828004 | A | 9/2010 |
| CN | 102061914 | A | 5/2011 |
| CN | 102305067 | A | 1/2012 |
| CN | 102513998 | A | 6/2012 |
| CN | 102587911 | A | 7/2012 |
| CN | 102606154 | A | 7/2012 |
| CN | 102704927 | B | 10/2012 |
| CN | 102733803 | A | 10/2012 |
| CN | 202500560 | U | 10/2012 |
| CN | 202991028 | U | 6/2013 |
| CN | 103206213 | A | 7/2013 |
| CN | 103498671 | A | 1/2014 |
| CN | 104047603 | A | 9/2014 |
| CN | 104500086 | A | 4/2015 |
| CN | 204283458 | U | 4/2015 |
| DE | 4123307 | C1 | 12/1992 |
| DE | 4440261 | A1 | 5/1996 |
| DE | 19900906 | A1 | 7/2000 |
| EP | 0176234 | A1 | 4/1986 |
| EP | 0329915 | A1 | 8/1989 |
| GB | 2214963 | A | 9/1989 |
| JP | S5540058 | U | 3/1980 |
| JP | 102147793 | A | 6/1990 |
| JP | H02147793 | A | 6/1990 |
| RU | 1779278 | C | 11/1992 |
| RU | 2044125 | C1 | 9/1995 |
| RU | 2142561 | C1 | 12/1999 |
| RU | 2187640 | C1 | 8/2002 |
| RU | 2209979 | C2 | 8/2003 |
| RU | 2276728 | C1 | 5/2006 |
| RU | 2441155 | C1 | 1/2012 |
| SU | 323552 | A | 11/1972 |
| SU | 514097 | A1 | 5/1976 |
| SU | 581263 | A1 | 11/1977 |
| SU | 619117 | A3 | 8/1978 |
| SU | 750061 | A1 | 7/1980 |
| SU | 804832 | A1 | 2/1981 |
| SU | 962626 | A1 | 9/1982 |
| SU | 1328521 | A1 | 8/1987 |
| SU | 1712599 | A1 | 2/1992 |
| SU | 1731946 | A1 | 5/1992 |
| SU | 1744249 | A1 | 6/1992 |
| WO | 0043637 | A1 | 7/2000 |
| WO | 0046486 | A1 | 8/2000 |
| WO | 0201045 | A1 | 1/2002 |
| WO | 02066793 | A1 | 8/2002 |
| WO | 2003062587 | A1 | 7/2003 |
| WO | 03089761 | A1 | 10/2003 |
| WO | 2012156843 | A2 | 9/2005 |
| WO | 2006075910 | A1 | 7/2006 |
| WO | 2016055087 | A1 | 4/2016 |

OTHER PUBLICATIONS

International Mining, "DynaCut Technology Achieving Breakthroughs," <https://im-mining.com/2015/12/17/dynacut-technology-achieving-breakthroughs/> web page accessed Nov. 22, 2019.

Mining3 Mining, "CRCMining Joy Global Oscillating Disc Cutter (ODC) Hard Rock Cutting Machine," <https://www.youtube.com/watch?v=anyPQWkH4rM> web page accessed Oct. 24, 2019.

Chilean Patent Office Search Report and Examiner's Report for Application No. 201900743 dated Feb. 3, 2020 (24 pages including statement of relevance).

Chilean Patent Office Search Report and Examiner's Response for Application No. 201900743 dated Sep. 14, 2020 (31 pages including statement of relevance).

Chinese Patent Office Action for Application No. 201780069536.0 dated Jun. 23, 2020 (11 pages including English summary).

Extended European Search Report issued by the European Patent Office for Application No. 17853958.1 dated Aug. 13, 2020 (8 pages).

Russian Patent Office Action for Application No. 2019112099 dated Nov. 10, 2020 (8 pages including English translation).

Chinese Patent Office Action for Application No. 201780069536.0 dated Mar. 1, 2021 (11 pages including English summary).

Australian Patent Office Examination Report No. 1 for Application No. 2017330397 dated Jun. 30, 2022 (3 pages).

European Patent Office Action for Related Application No. 17853958.1 dated Oct. 10, 2022 (2 pages).

* cited by examiner

ROCK CUTTING DEVICE

CROSS-REFERENCE TO RELATED APPLICATIONS

This application is a continuation of prior-filed, co-pending U.S. patent application Ser. No. 15/712,428, filed Sep. 22, 2017, which claims the benefit of U.S. Provisional Patent Application No. 62/398,744, filed Sep. 23, 2016, U.S. Provisional Patent Application No. 62/398,717, filed Sep. 23, 2016, and U.S. Provisional Patent Application No. 62/398,834, filed Sep. 23, 2016. The entire contents of these documents are incorporated by reference herein.

BACKGROUND

The present disclosure relates to mining and excavation machines, and in particular to a cutting device for a mining or excavation machine.

Hard rock mining and excavation typically requires imparting large energy on a portion of a rock face in order to induce fracturing of the rock. One conventional technique includes operating a cutting head having multiple mining picks. Due to the hardness of the rock, the picks must be replaced frequently, resulting in extensive down time of the machine and mining operation. Another technique includes drilling multiple holes into a rock face, inserting explosive devices into the holes, and detonating the devices. The explosive forces fracture the rock, and the rock remains are then removed and the rock face is prepared for another drilling operation. This technique is time-consuming and exposes operators to significant risk of injury due to the use of explosives and the weakening of the surrounding rock structure. Yet another technique utilizes roller cutting element(s) that rolls or rotates about an axis that is parallel to the rock face, imparting large forces onto the rock to cause fracturing.

SUMMARY

In one aspect, a rock excavating device includes a shaft and a cutting element. The shaft includes a first portion and a second portion connected to an end of the first portion. The first portion is rotatable about a first axis. The second portion extends along a second axis that is oblique with respect to the first axis. The cutting element includes a cutting edge. The cutting element is supported on the second portion and rotatable about the second axis. Rotation of the first portion of the shaft about the first axis changes the orientation of the second axis and the cutting element.

In another aspect, a cutting assembly for a rock excavation machine includes a boom and a cutting device supported on the boom. The cutting device includes a shaft and a cutting edge. The shaft includes a first portion and a second portion. The first portion is rotatable about a first axis. The cutting edge is supported on the second portion and is rotatable about a second axis oriented obliquely with respect to the first axis. The shaft is supported for rotation about the first axis, thereby changing an orientation of the second portion and the second axis relative to the boom.

In yet another aspect, a rock excavating device includes a shaft and a cutting element. The shaft includes a first portion and a second portion. The first portion is supported for free rotation about a first axis, and rotation of the first portion changes an orientation of the second portion. The cutting element includes a cutting edge. The cutting element is supported on the second portion and is rotatable about a second axis oriented obliquely relative to the first axis.

Other aspects will become apparent by consideration of the detailed description and accompanying drawings.

DETAILED DESCRIPTION

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical or hydraulic connections or couplings, whether direct or indirect. Also, electronic communications and notifications may be performed using any known means including direct connections, wireless connections, etc.

In addition, it should be understood that embodiments of the invention may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, aspects of the invention may be implemented in software (for example, stored on non-transitory computer-readable medium) executable by one or more processing units, such as a microprocessor, an application specific integrated circuits ("ASICs"), or another electronic device. As such, it should be noted that a plurality of hardware and software based devices, as well as a plurality of different structural components may be utilized to implement the invention. For example, "controllers" described in the specification may include one or more electronic processors or processing units, one or more computer-readable medium modules, one or more input/output interfaces, and various connections (for example, a system bus) connecting the components.

Figure 1:
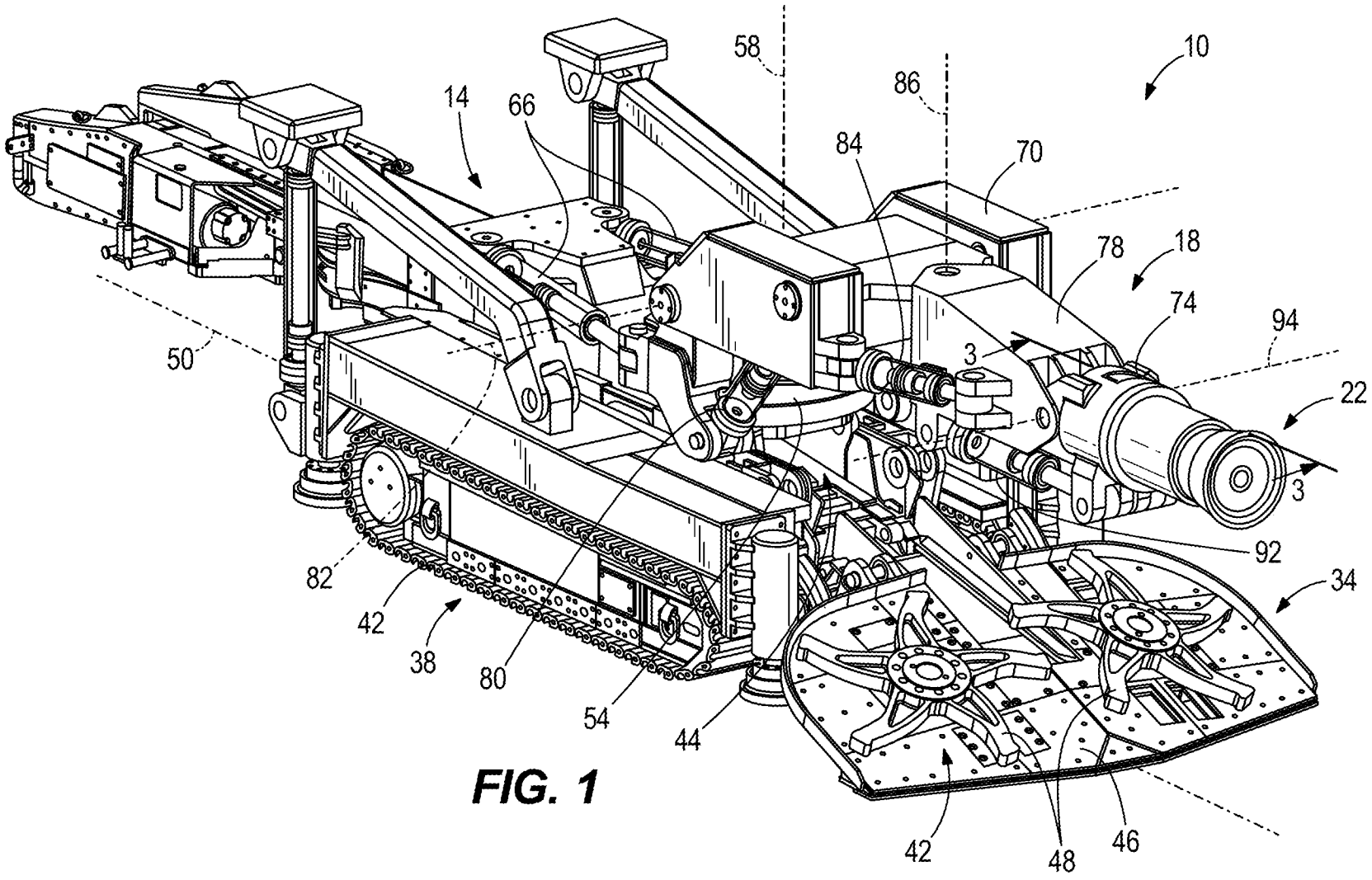
FIG. 1 is a perspective view of a mining machine.

FIG. 1 illustrates a rock excavating machine or mining machine 10 (e.g., an entry development machine) including a chassis 14, a boom 18, a rock excavating device or cutting device or cutter head 22 for engaging a rock face 30 (FIG. 8), and a material handling system 34. In the illustrated embodiment, the chassis 14 is supported on a traction drive device (e.g., a crawler mechanism 38) for movement relative to a floor (not shown). In the illustrated embodiment, the crawler 38 includes a roller-type crawler track 42. The chassis 14 includes a first or forward end and a second or rear end, and a longitudinal chassis axis 50 extends between the forward end and the rear end.

In the illustrated embodiment, the boom 18 is supported on a turret or turntable or swivel joint 54 for pivoting relative to the chassis 14. The swivel joint 54 (FIG. 3) is supported for rotation (e.g., by a slew bearing, not shown) about a swivel axis 58 that is perpendicular to the chassis axis 50 (e.g., the swivel axis 58 is perpendicular to the support surface) to pivot the boom 18 in a plane that is generally parallel the chassis axis 50 (e.g., a plane parallel to the support surface). In the illustrated embodiment, slew actuators or cylinders 66 extend and retract to pivot the swivel joint 54 and the boom 18 about the swivel axis 58. In some embodiments, the swivel joint 54, the boom 18, the cutter head 22, and the material handling system 34 are supported on a common sumping frame that is movable relative to the chassis 14. Movement of the sumping frame permits the cutter head 22 and material handling system 34 to be moved parallel to the chassis axis 50 and advanced toward the rock face 30 while the chassis 14 remains secured in position relative to the ground.

The material handling system 34 includes a shovel or gathering head 42 and a conveyor 44. The gathering head 42 includes an apron or deck 46 and rotating arms 48. As the mining operation advances, the cut material is urged onto the deck 46, and the rotating arms 48 move the cut material onto the conveyor 44 for transporting the material to a rear end of the machine 10. In other embodiments, the arms may slide or wipe across a portion of the deck 46 (rather than rotating) to direct cut material onto the conveyor 44. The conveyor 44 may be a chain conveyor driven by one or more sprockets. In the illustrated embodiment, the conveyor 44 is coupled to the gathering head 42 and is supported for movement with the gathering head 42 relative to the chassis 14.

As shown in FIG. 1, the boom 18 includes a first or base portion 70, a second or wrist portion 74 supporting the cutter head 22, and an intermediate portion 78 positioned between the base portion 70 and the wrist portion 74. In the illustrated embodiment, the base portion 70 is pivotably coupled to the swivel joint 54 (e.g., by a pin joint), and the base portion 70 is pivoted or "luffed" relative to the swivel joint 54 by first actuators 80 (e.g., fluid cylinders). The extension and retraction of the first actuators 80 pivot the base portion 70 about a luff axis or first pivot axis 82. The first pivot axis 82 may be transverse to the swivel axis 54 such that extension and retraction of the first actuators 80 causes the base portion 70 to move between an upper position and a lower position. In addition, the intermediate portion 78 is pivotably coupled to the base portion 70 (e.g., by a pin joint), and the intermediate portion 78 is pivoted relative to the base portion 70 by second actuators 84 (e.g., second fluid cylinders). The extension and retraction of the second actuators 84 pivots the intermediate portion 78 about a second pivot axis 86 offset from the first pivot axis 82. In the illustrated embodiment with the boom elements oriented as shown, the second pivot axis 86 is substantially perpendicular to the luff axis or first pivot axis 82. In other embodiments (not shown), a base portion of the boom may instead be coupled to the frame and supported for pivoting movement about a lateral axis or luffing axis, and a swivel joint may be formed on a portion of the boom. It is understood that other embodiments may include various configurations of articulating portions for the boom.

Furthermore, the wrist portion 74 includes lugs 90 (FIG. 2) that are pivotably coupled to the intermediate portion 78 (e.g., by a pin joint). The wrist portion 74 is pivoted relative to the intermediate portion 78 by wrist actuators 92 (e.g., fluid cylinders). The extension and retraction of the wrist actuators 92 pivots the wrist portion 74 about a wrist axis 94 offset from the first pivot axis 82 and the second pivot axis 86. In the illustrated embodiment, the second pivot axis 86 is substantially perpendicular to the first pivot axis 82 and is substantially perpendicular to the wrist axis 94.

Figure 2:
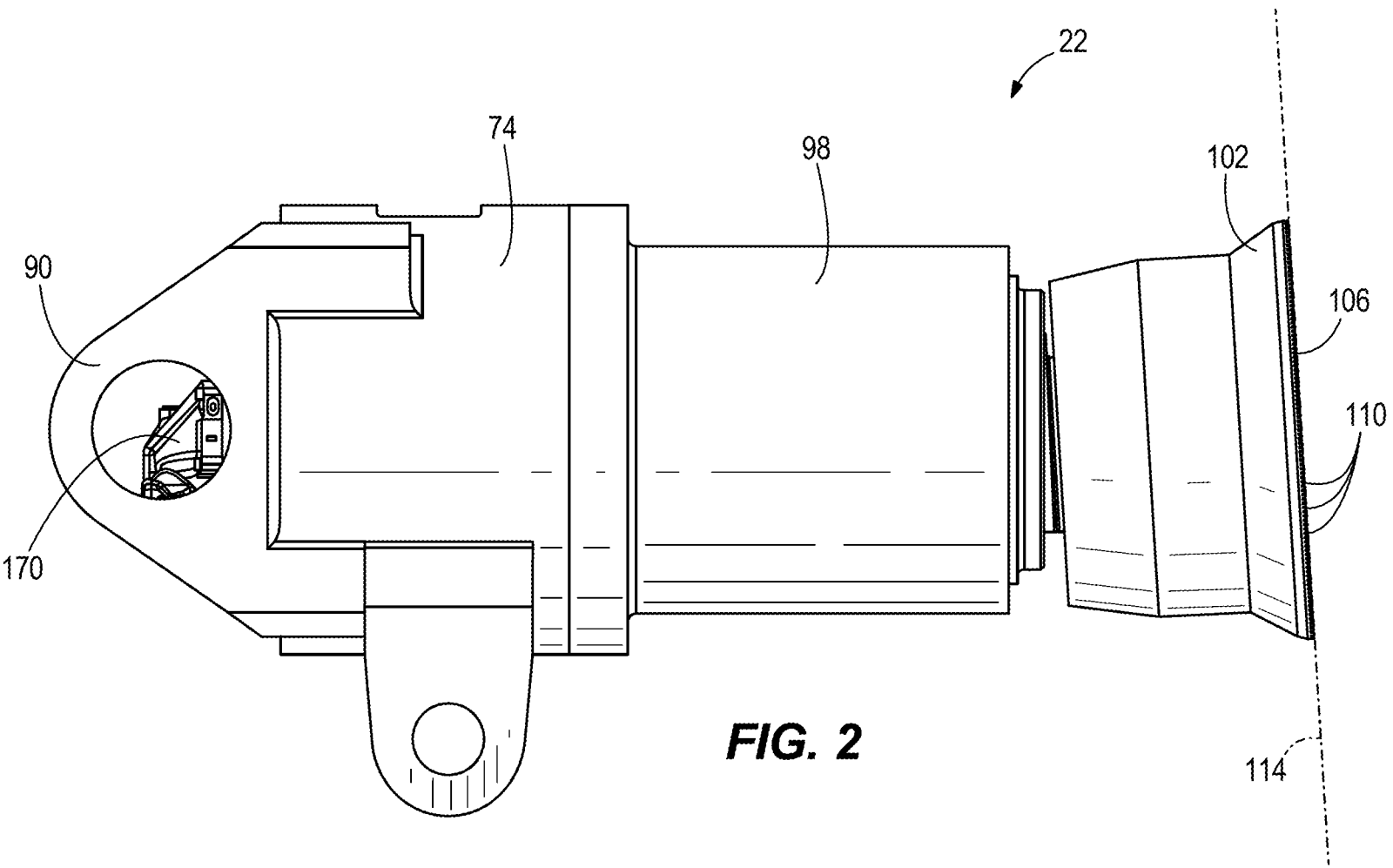
FIG. 2 is a side view of a cutter head.
Figure 3:
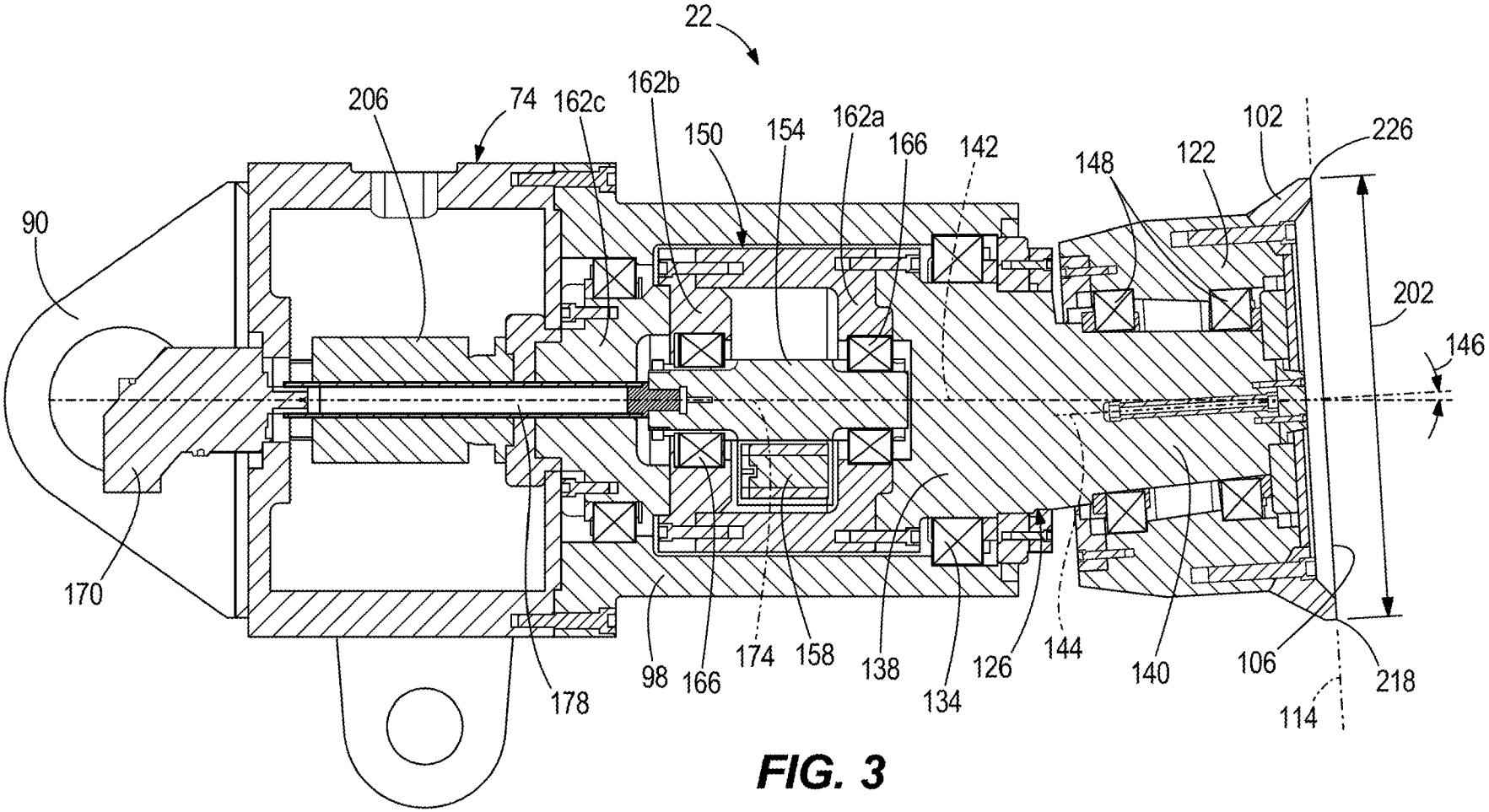
FIG. 3 is cross-section view of the cutter head of FIG. 2, viewed along section 3-3 illustrated in FIG. 1.
Figure 4:
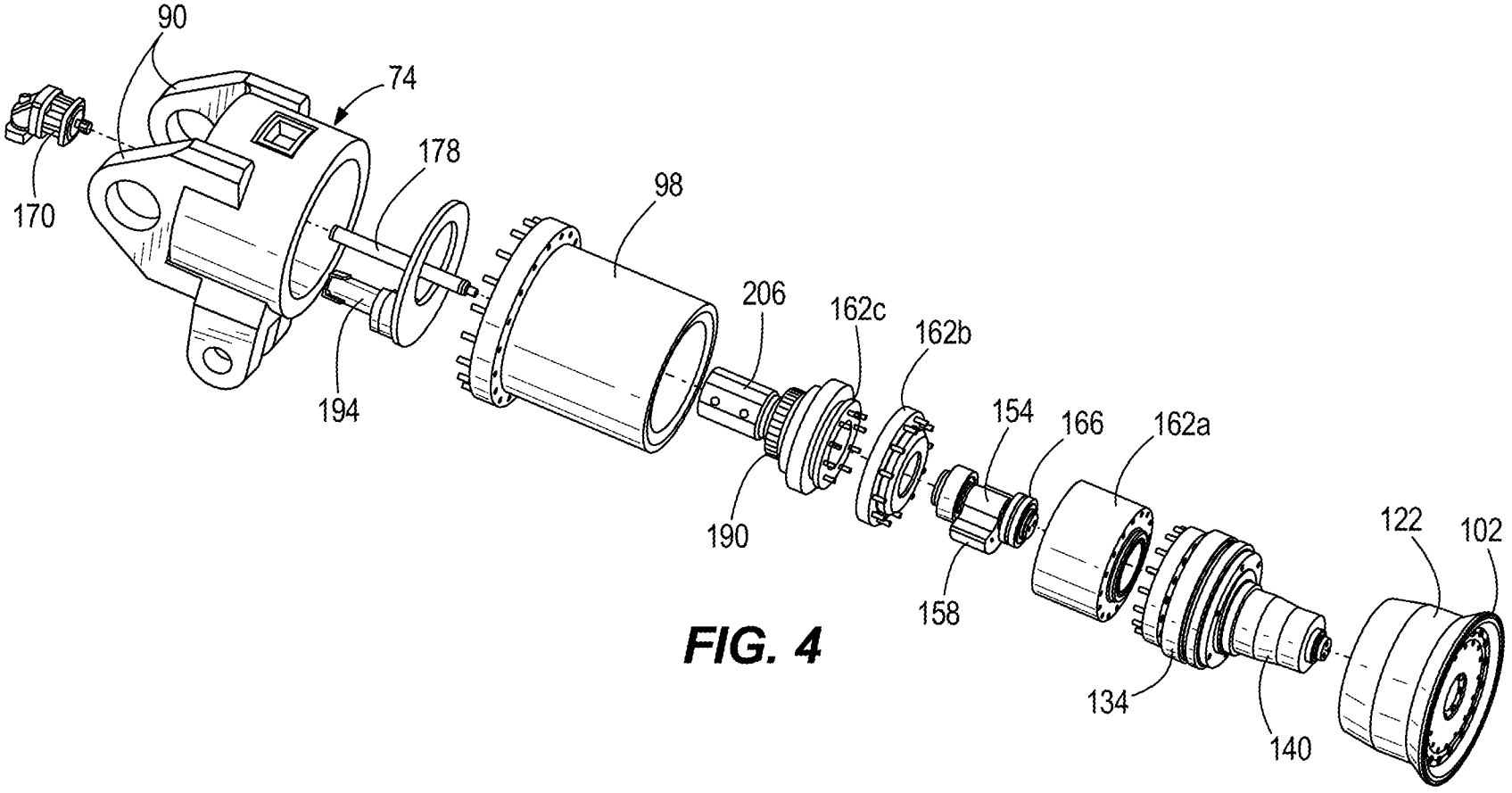
FIG. 4 is an exploded view of the cutter head of FIG. 2.
Figure 5:
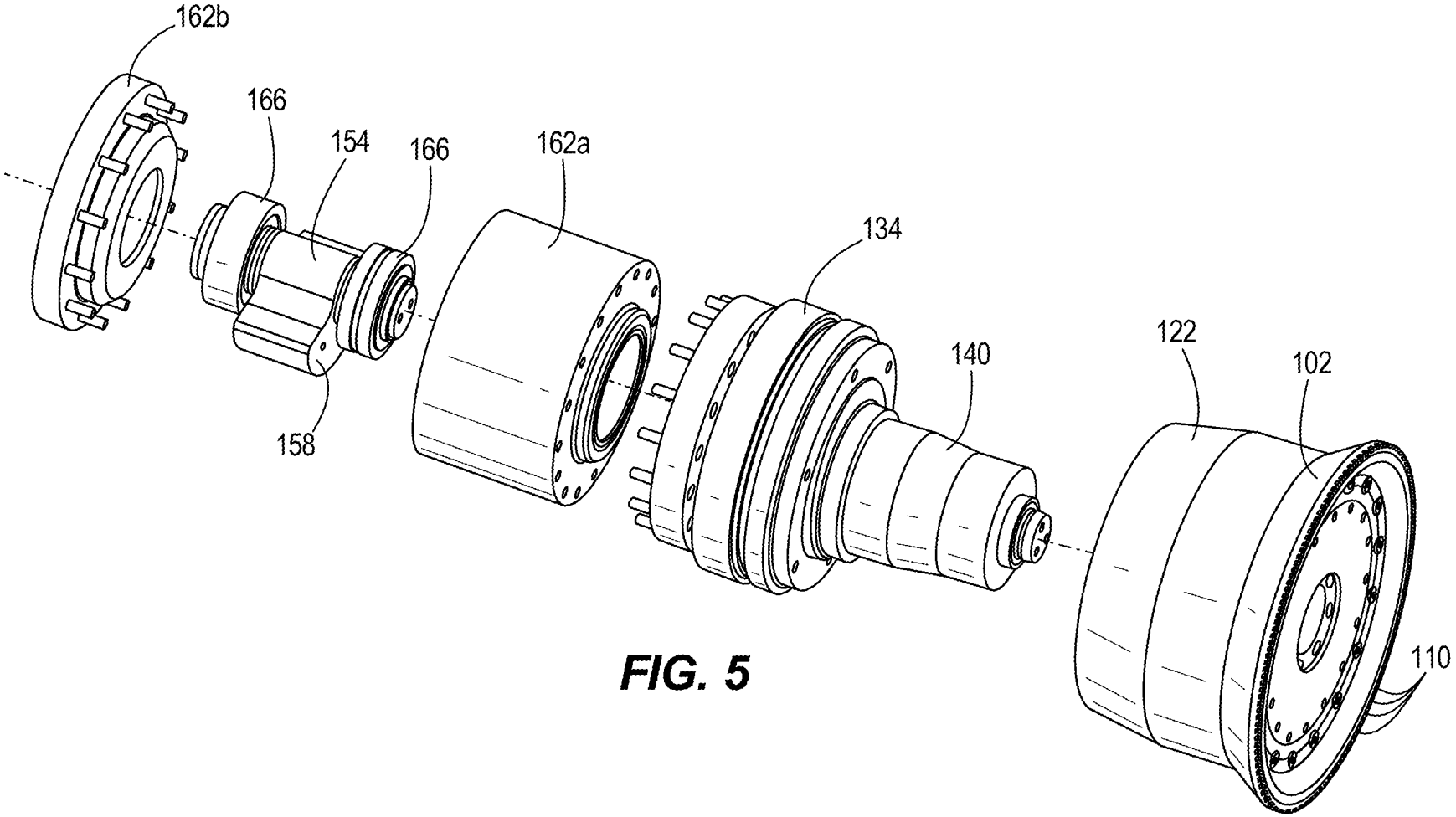
FIG. 5 is an exploded view of a portion of the cutter head of FIG. 4.

As shown in FIG. 2, the cutter head 22 includes a housing 98 supported on an end of the wrist portion 74 and is spaced apart from the intermediate portion 78 (FIG. 1). In the illustrated embodiment, the housing 98 is formed as a separate structure that is removably coupled to the wrist portion 74 (e.g., by fasteners). The cutter head 22 is positioned adjacent a distal end of the boom 18 (FIG. 1). As shown in FIGS. 2 and 3, the cutter head 22 includes a cutting member or bit or cutting disc 102 having a peripheral edge 106, and a plurality of cutting bits 110 are positioned along the peripheral edge 106. The peripheral edge 106 may have a round (e.g., circular) profile with the cutting bits 110 oriented in a common plane or cutting plane 114.

Referring now to FIG. 3, the cutting disc 102 is rigidly coupled to a carrier 122 that is supported on a shaft 126. The shaft 126 includes a first portion 138 and a second portion 140. The first portion 138 is supported for rotation relative to the housing 98 by one or more shaft bearings 134 (e.g., tapered roller bearings), and the first portion 138 rotates about a first axis 142. The second portion 140 of the shaft 126 extends along a second axis 144 that is oblique or non-parallel to the first axis 142. In the illustrated embodiment, the second axis 144 forms an acute angle 146 relative to the first axis 142.

In some embodiments, the angle 146 greater than approximately 0 degrees and less than approximately 25 degrees. In some embodiments, the angle 146 is between approximately 1 degree and approximately 15 degrees. In some embodiments, the angle 146 is between approximately 1 degree and approximately 10 degrees. In some embodiments, the angle 146 is between approximately 1 degree and approximately 7 degrees. In some embodiments, the angle 146 is approximately 3 degrees.

The second portion 140 supports the carrier 122 and the cutting disc 102 for rotation about the second axis 144. In particular, the carrier 122 is supported for rotation relative to the shaft 126 by carrier bearings 148 (e.g., tapered roller bearings). In the illustrated embodiment, the second axis 144 represents a cutting axis about which the cutting disc 102 rotates, and the second axis 144 is perpendicular to the cutting plane 114. Also, in the illustrated embodiment, the second axis 144 intersects the first axis 142 at the center of the forward face of the cutting disc 102, or at the center of the cutting plane 114 defined by the cutting bits 110.

An excitation element 150 is positioned in the housing 98 adjacent the first portion 138 of the shaft 126. The excitation element 150 includes an exciter shaft 154 and an eccentric mass 158 positioned on the exciter shaft 154. The exciter shaft 154 and the eccentric mass 158 may be supported in an exciter case 162. The exciter shaft 154 is supported for rotation relative to the exciter case 162 by exciter bearings 166 (e.g., roller bearings, such as spherical roller bearings, compact aligning roller bearings, and/or toroidal roller bearings). The exciter shaft 154 is coupled to an exciter motor 170 and the exciter shaft 154 is driven to rotate about an exciter axis 174. The eccentric mass 158 is offset from the exciter axis 174. In the illustrated embodiment, the exciter axis 174 is aligned with the first axis 142. In other embodiments, the exciter axis 174 may be oriented parallel to and offset from the first axis 142. In still other embodiments, the exciter axis 174 may be inclined or oriented at an oblique angle relative to the first axis 142. The exciter axis 174 may also be positioned both offset and inclined relative to the first axis 142.

In the illustrated embodiment, the exciter motor 170 is supported on the wrist portion 74, and the exciter shaft 154 is connected to an output shaft of the exciter motor 170 by a coupler 178 extending between an end of the exciter shaft 154 and the exciter motor 170. Also, in the illustrated embodiment, the exciter case 162 includes multiple sections (162*a*, 162*b*, 162*c*) secured to one another and secured to the shaft 126. That is, the exciter case 162 rotates with the shaft 126 and is supported for rotation relative to the housing 98. In other embodiments, the exciter case 162 may be formed integrally with the shaft 126.

The rotation of the eccentric mass 158 about the exciter axis 174 induces an eccentric oscillation in the housing 98, the shaft 126, the carrier 122, and the cutting disc 102. In some embodiments, the excitation element 150 and cutter head 22 are similar to the exciter member and cutting bit described in U.S. Publication No. 2014/0077578, published Mar. 20, 2014, the entire contents of which are hereby incorporated by reference. In the illustrated embodiment, the carrier 122 and the cutting disc 102 are freely rotatable relative to the shaft 126; that is, the cutting disc 102 is neither prevented from rotating nor positively driven to rotate, except by the induced oscillation caused by the excitation element 150 and/or by the reaction forces exerted on the cutting disc 102 by the rock face 30. In other embodiments in which the exciter axis 174 is offset and/or inclined relative to the first axis 142, the rotation of the eccentric mass 158 would cause both excitation or oscillation in both a radial direction (perpendicular to the first axis 142) and an axial direction (parallel to the first axis 142).

Figure 6:
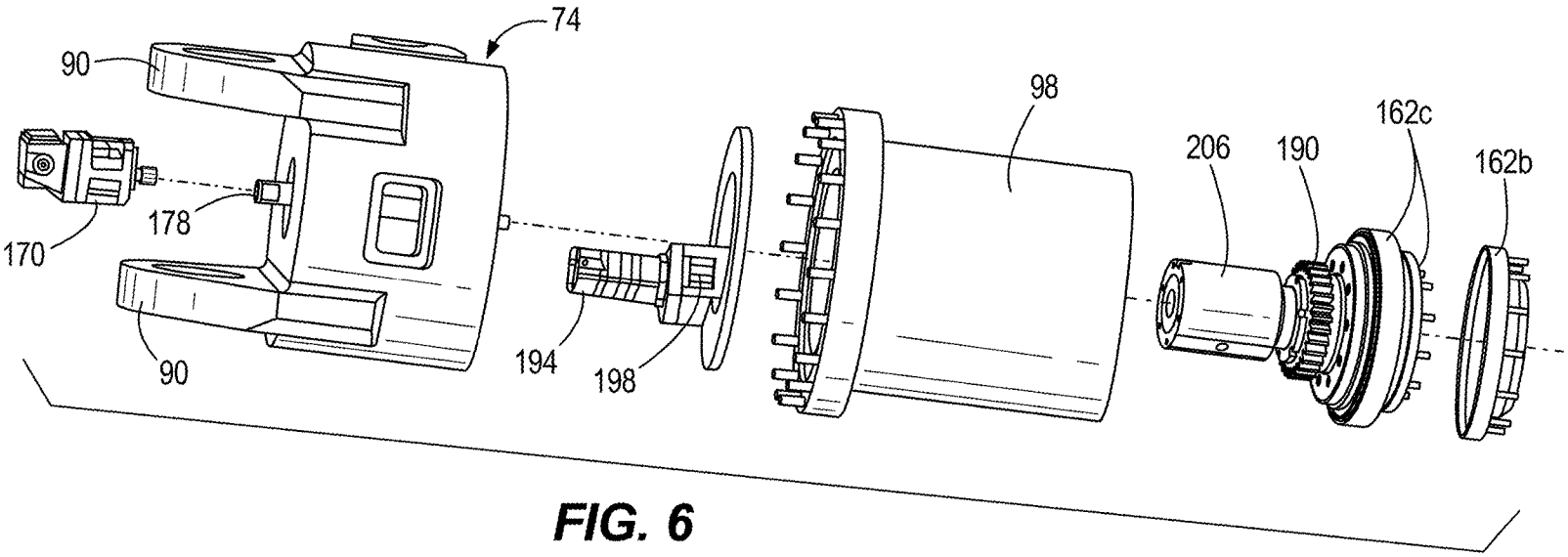
FIG. 6 is an exploded view of a portion of the cutter head of FIG. 2.
Figure 7:
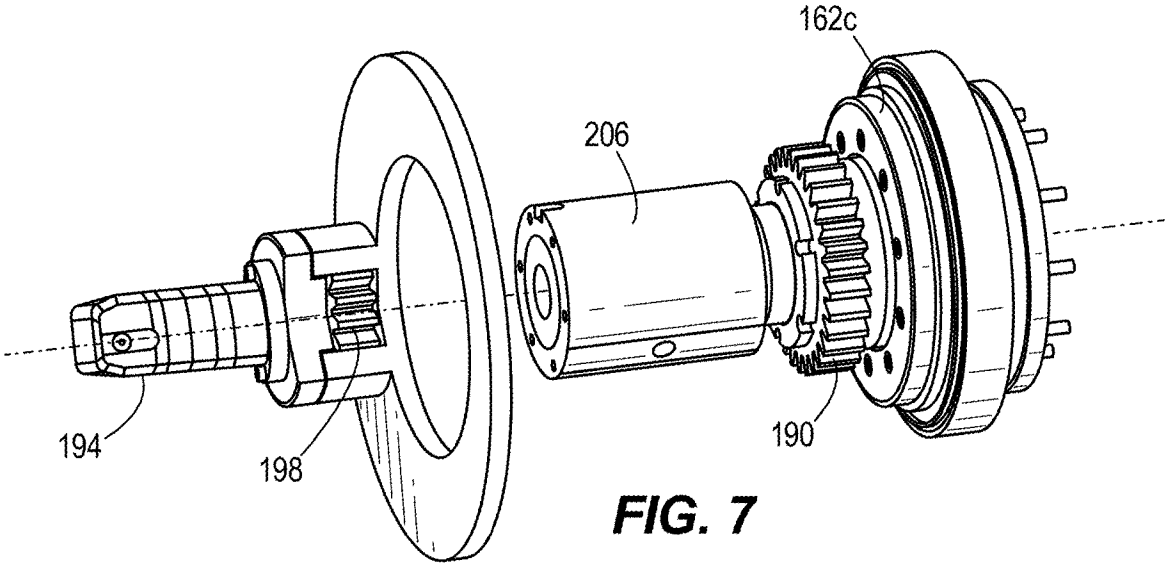
FIG. 7 is an exploded view of a portion of the cutter head of FIG. 6.

Referring to FIGS. 6 and 7, an end of the exciter case 162 is secured to a gear surface 190 (e.g., a spur gear, a toothed belt, etc.). In addition, the cutter head 22 includes a second motor 194 supported adjacent the end of the exciter case 162. The second motor 194 includes an output shaft (not shown) coupled to a pinion 198 that meshes with or engages the gear surface 190. Operation of the second motor 194 drives the pinion 198, thereby rotating the gear surface 190. The rotation of the gear surface 190 rotates the exciter case 162 and the shaft 126 about the first axis 142. As a result, the second portion 140 of the shaft 126 also rotates, thereby changing the orientation of the second axis 144 about which the cutting disc 102 rotates. For example, the cutting disc 102 in FIG. 3 is oriented for cutting in a downward direction; to adjust the cutter clearance to change the cutting direction (e.g., to an upward direction), the shaft 126 may be rotated 180 degrees.

In the illustrated embodiment, the second axis 144 intersects the first axis 142 at the center of the forward face of the cutting disc 102 (i.e., the center of the cutting plane 114 defined by the peripheral edge 106 in the illustrated embodiment), or very close to the center of the plane 114. As a result, the center of the cutting disc 102 remains in a fixed (or nearly fixed) relative position as the shaft 126 rotates, avoiding translation of the cutting disc 102 as the shaft 126 is rotated. In other embodiments, a small offset between the axes 142, 144 could exist.

Also, in the illustrated embodiment, the cutter head 22 includes a rotary union or fluid swivel 206 for providing fluid communication between a fluid source and the components in the cutter head 22. The swivel 206 may transmit various types of fluids, including lubricant, hydraulic fluid, water, or another medium for flushing cut rock and/or cooling the cutting disc 102. In some embodiments, the swivel 206 is positioned between the exciter motor 170 and the exciter shaft 154, and the coupler 178 extends through the swivel 206. In other embodiments, the components may be positioned in a different manner.

Figure 8:
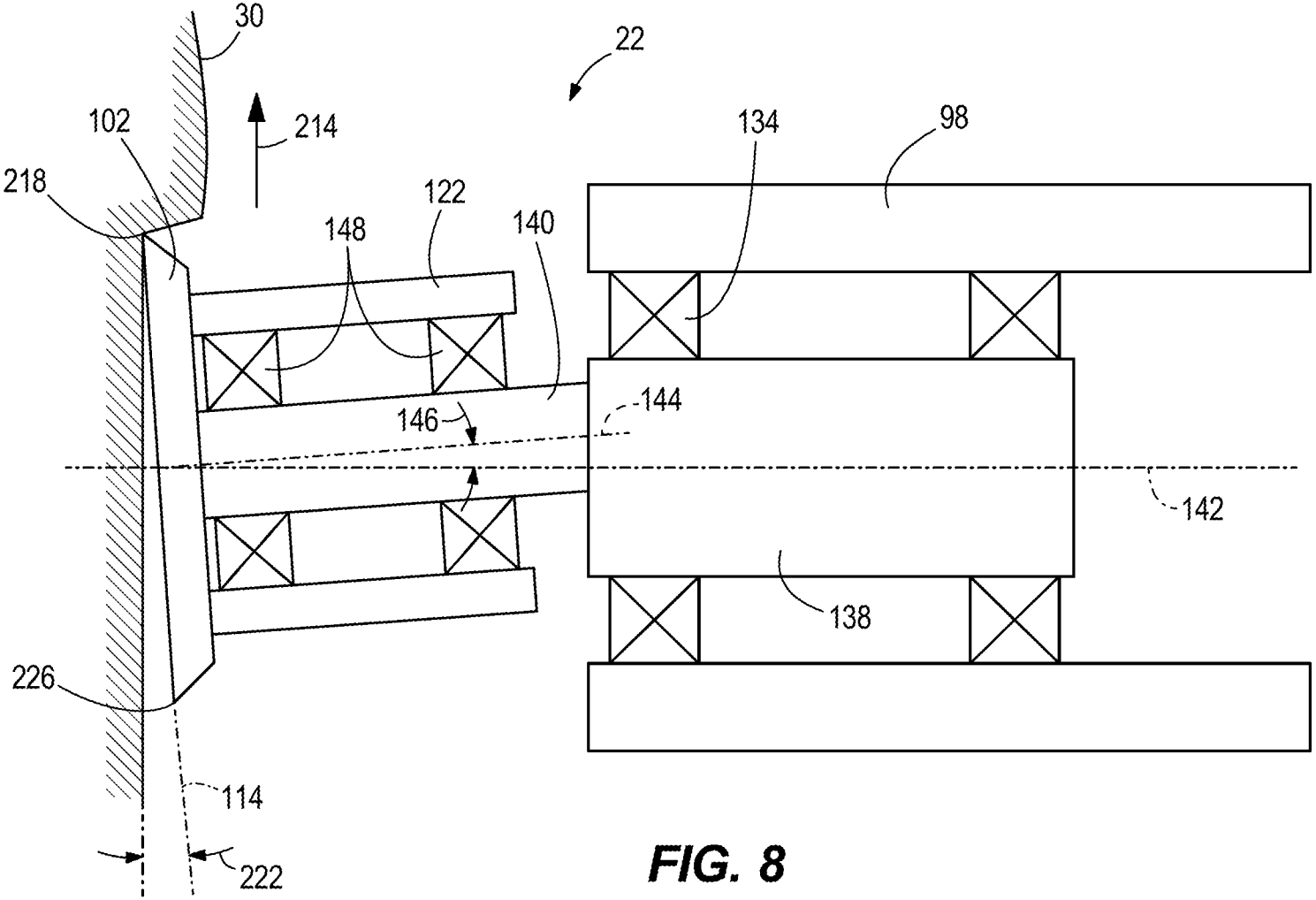
FIG. 8 is a schematic view of the cutter head of FIG. 2 engaging a rock face.

FIG. 8 illustrates a schematic view of the cutter head 22 engaging the rock face 30 in an undercutting manner. The cutting disc 102 traverses across a length of the rock face 30 in a cutting direction 214. A leading portion 218 of the cutting disc 102 contacts the rock face 30 at a contact point. The cutting plane 114, which is oriented perpendicular to the second axis 144, generally forms an acute angle 222 relative to a tangent of the rock face 30 such that a trailing portion 226 of the cutting disc 102 (i.e., a portion of the disc that is positioned behind the leading portion 218 with respect to the cutting direction 214) is spaced away from the rock face 30. The angle 222 provides clearance between the rock face 30 and the trailing portion 226.

By rotating the shaft 126, an operator can modify the orientation of the second axis 144 and therefore the orientation of the cutting disc 102. A plane (e.g., the plane of the cross-section of FIG. 3) containing both the first axis 142 and the second axis 144 also contains a width or diameter 202 of the peripheral edge 106. The diameter 202 extends between the point on the cutting disc 102 that is closest to the face 30 relative to the first axis 142 (i.e., the leading portion 218) and the point on the cutting disc 102 that is furthest from the face 30 relative to the first axis 142 (i.e., the trailing portion 226). To cut in a desired direction, the operator rotates the shaft 126 such that the plane containing the first axis 142 and second axis 144 is aligned with the desired cutting direction.

The cutter head 22 is omni-directional, being capable of efficiently cutting in any direction and changing the cutting direction. A controller may coordinate the translation of the cutting disc 102 across the face 30 and the rotation of the second portion 140 of the shaft 126 during cutting direction changes to prevent axial interference between the cutting disc 102 and the face 30. In addition, the structure of the boom 18 with multiple pivot axes is compact and versatile, simplifying the suspension and control of the wrist portion 74 and reducing the frequency with which the position and orientation of the cutter head 22 must be re-configured.

Although the intersection of the first axis 142 and the second axis 144 has been described above as being located at a center of the cutting plane 114, it is possible that the intersection of the axes 142, 144 may be offset by a small distance from the cutting plane 114. In such a condition, the center of the cutting plane 114 will move as the shaft 126 is rotated, resulting in a small translation of the cutting disc 102. The cutting disc 102 may still cut rock in such a condition, and the cutting characteristics can change depending on the offset distance between the intersection point and the cutting plane 114, and the characteristics of the rock to be cut (e.g., specific energy, or the energy required to excavate a unit volume of rock).

Figure 9:
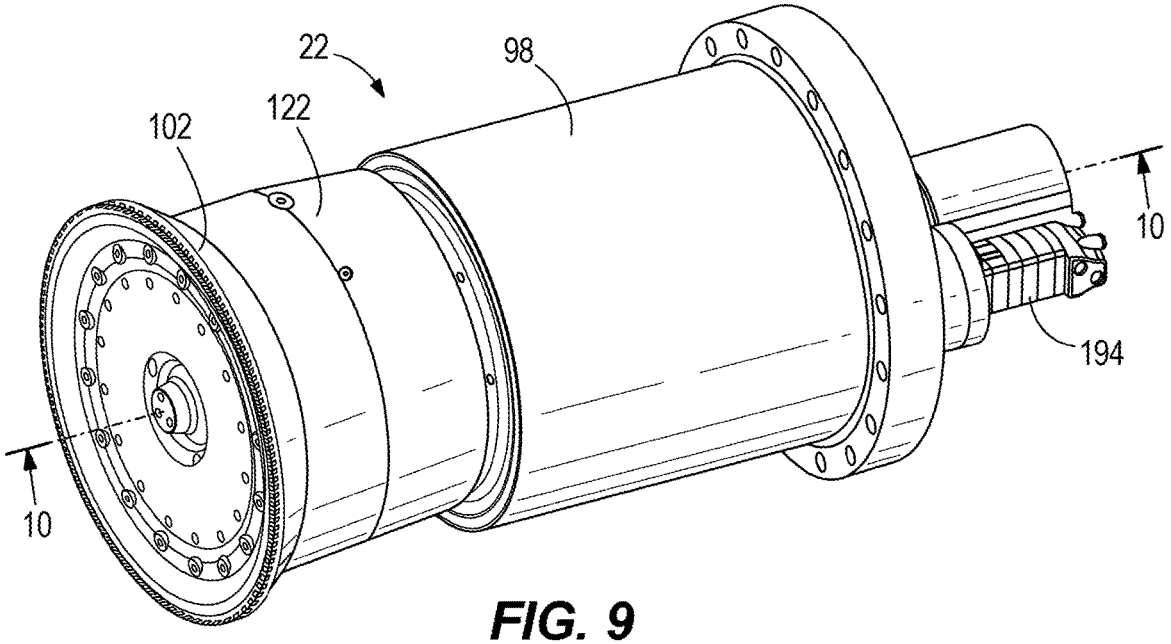
FIG. 9 is a perspective view of a cutter head according to another embodiment.
Figure 10:
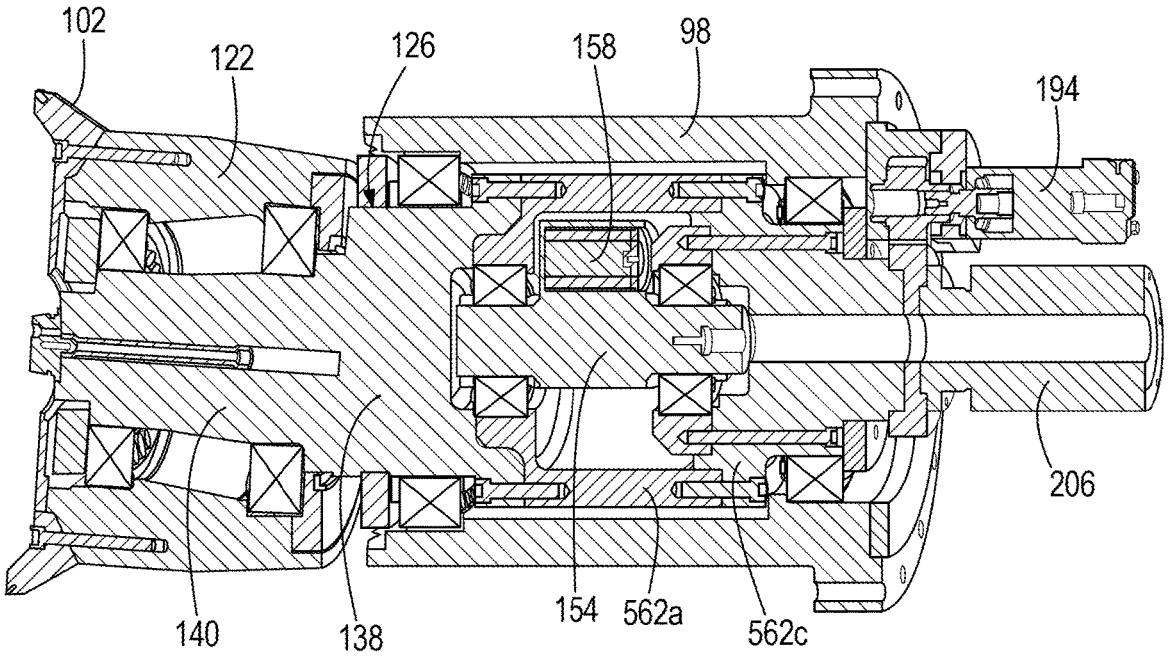
FIG. 10 is a cross-section view of the cutter head of FIG. 9, viewed along section 10-10.
Figure 11:
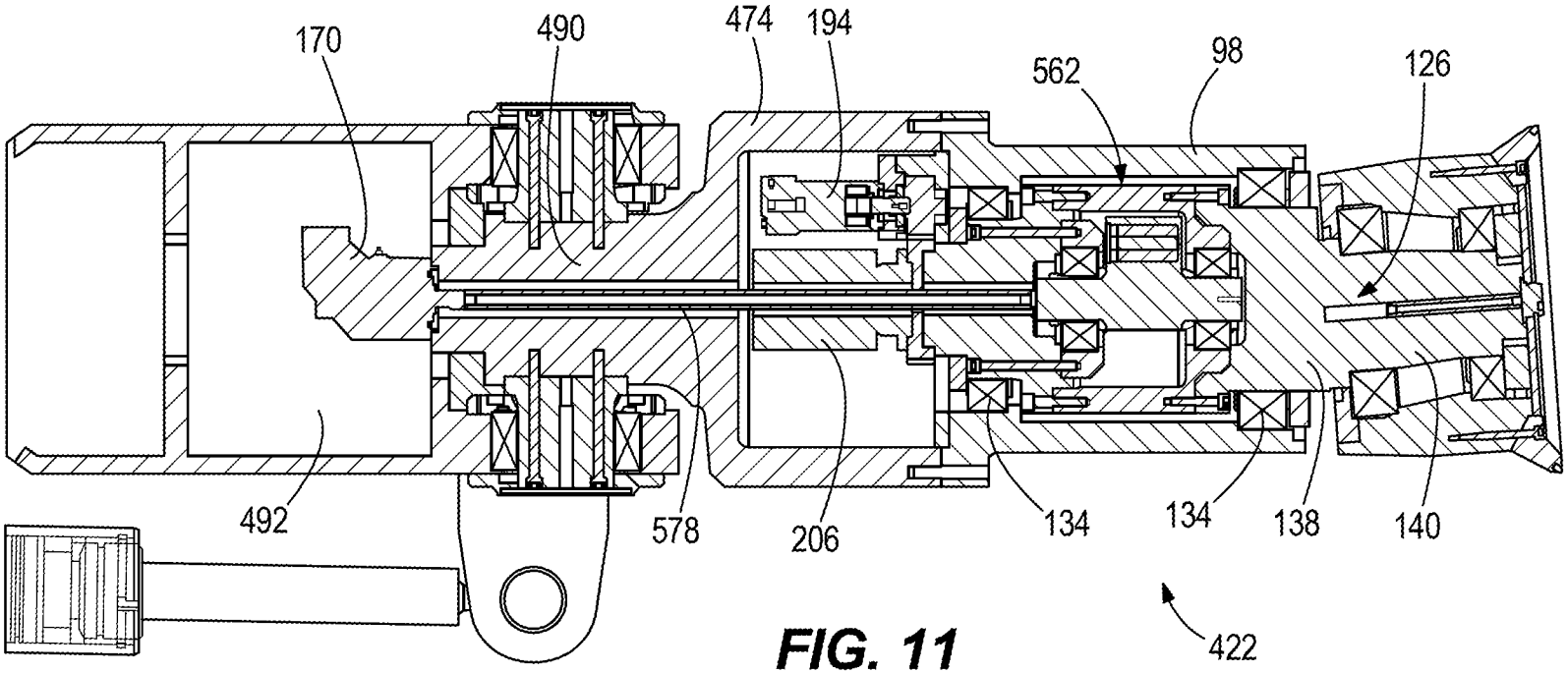
FIG. 11 is a side cross-section view of the cutter head of FIG. 9 and a boom according to one embodiment.

FIGS. 9 and 10 illustrate the cutter head 22 separate from the boom. As shown in FIG. 10, the exciter case 562 may have a different shape and construction from the exciter case 162 described above with respect to FIG. 3. In addition, FIG. 11 illustrates the cutter head 422 coupled to a wrist portion 474 according to another embodiment. Rather than lugs, the wrist portion 474 includes a shaft 490 that is supported for pivoting movement relative to stationary section 492. The coupler 574 is longer than the coupler 174 described above with respect to FIG. 3 in order to accommodate the additional distance between the exciter motor 170 and the exciter shaft 154.

Figure 12:
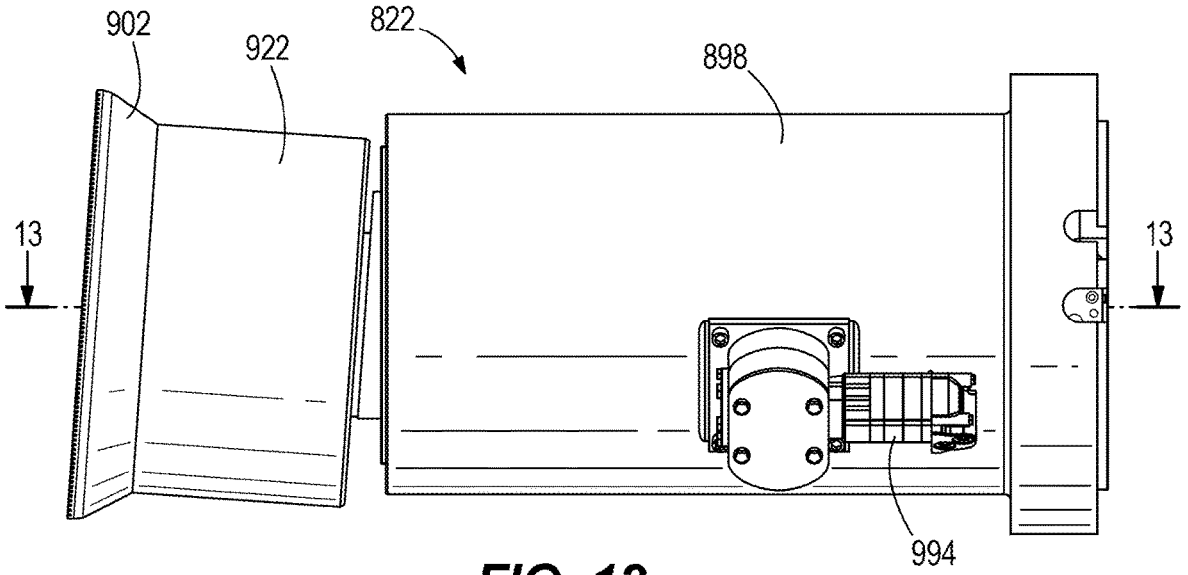
FIG. 12 is a perspective view of a cutter head according to another embodiment.
Figure 13:
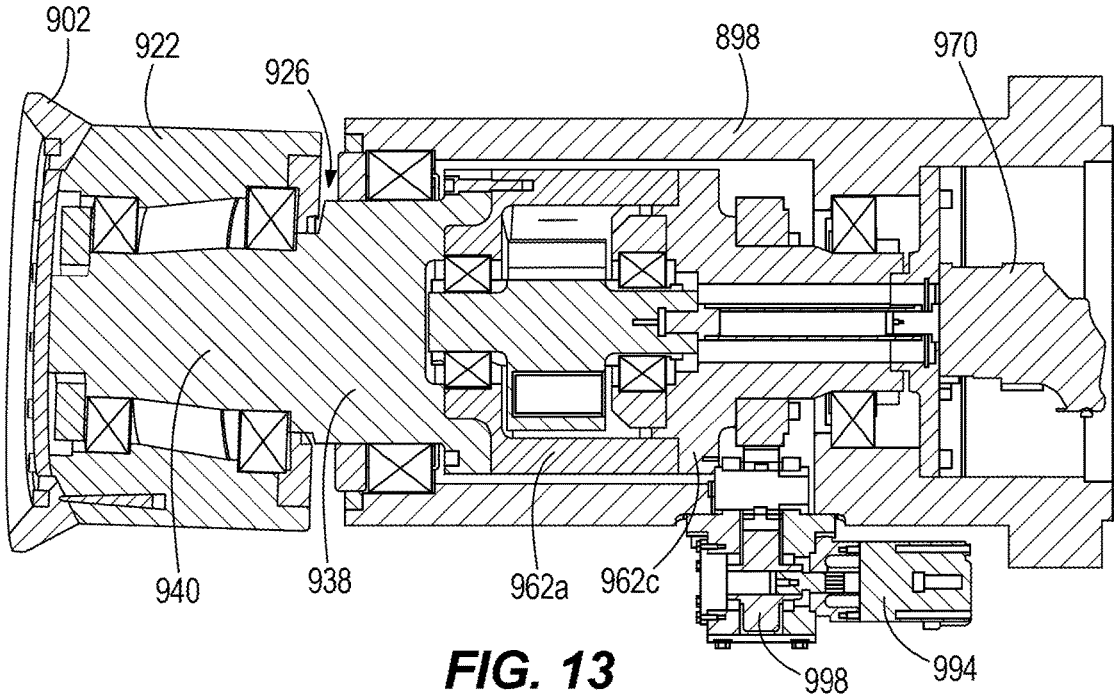
FIG. 13 is a side cross-section view of the cutter head of FIG. 12, viewed along section 13-13.

FIGS. 12 and 13 illustrate a cutter head 822 according to yet another embodiment. Many aspects of the cutter head 822 are similar to the cutter head 22, and similar features are identified with similar reference numbers, plus 800. cutter head 822 includes an exciter motor 970 that is supported on the housing 898 rather than supported on a portion of a boom. In addition, the second motor 994 is positioned outside the housing 898 instead of being positioned adjacent an end of the housing 898.

Figure 14:
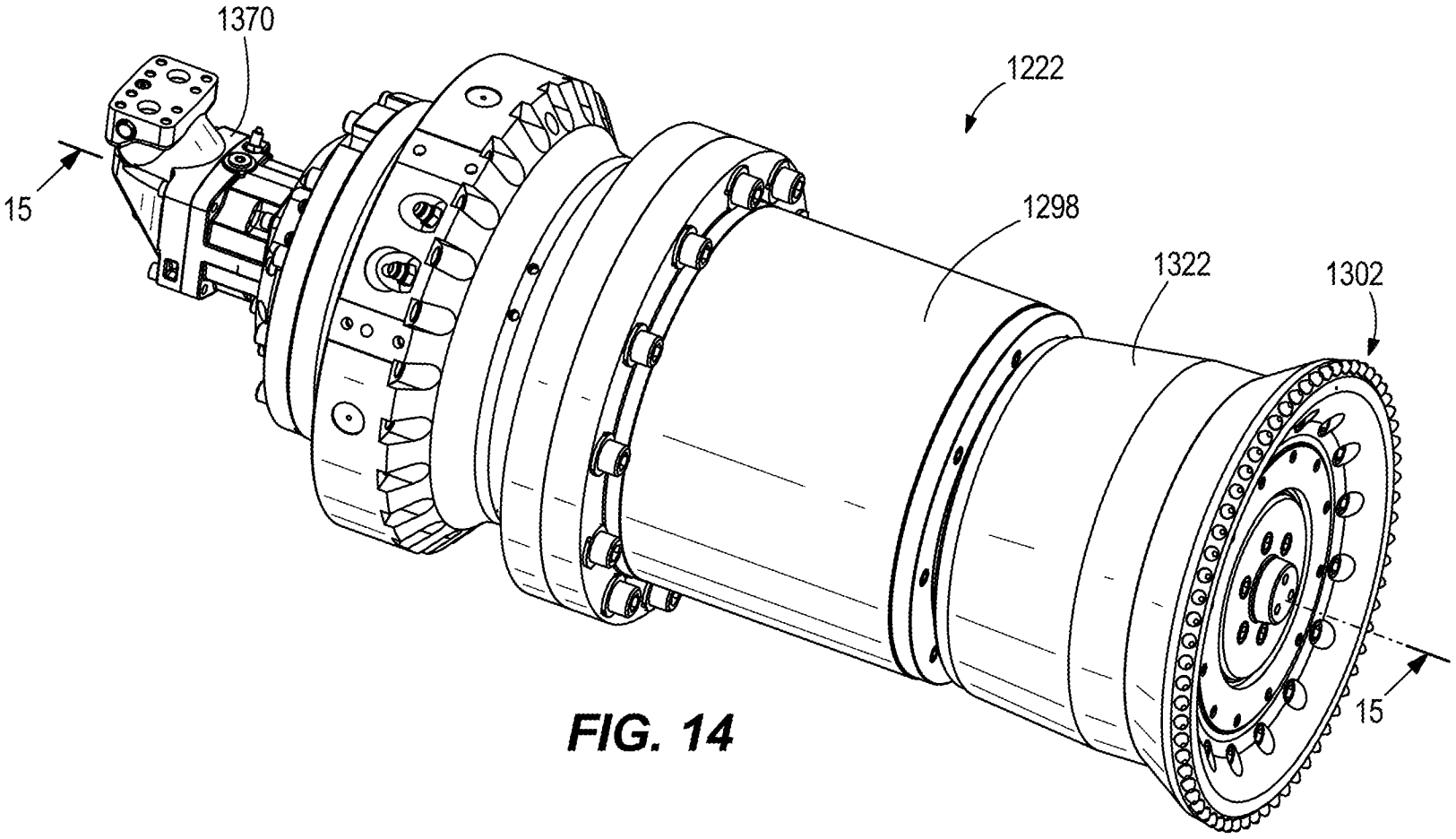
FIG. 14 is a perspective view of a cutter head according to another embodiment.
Figure 15:
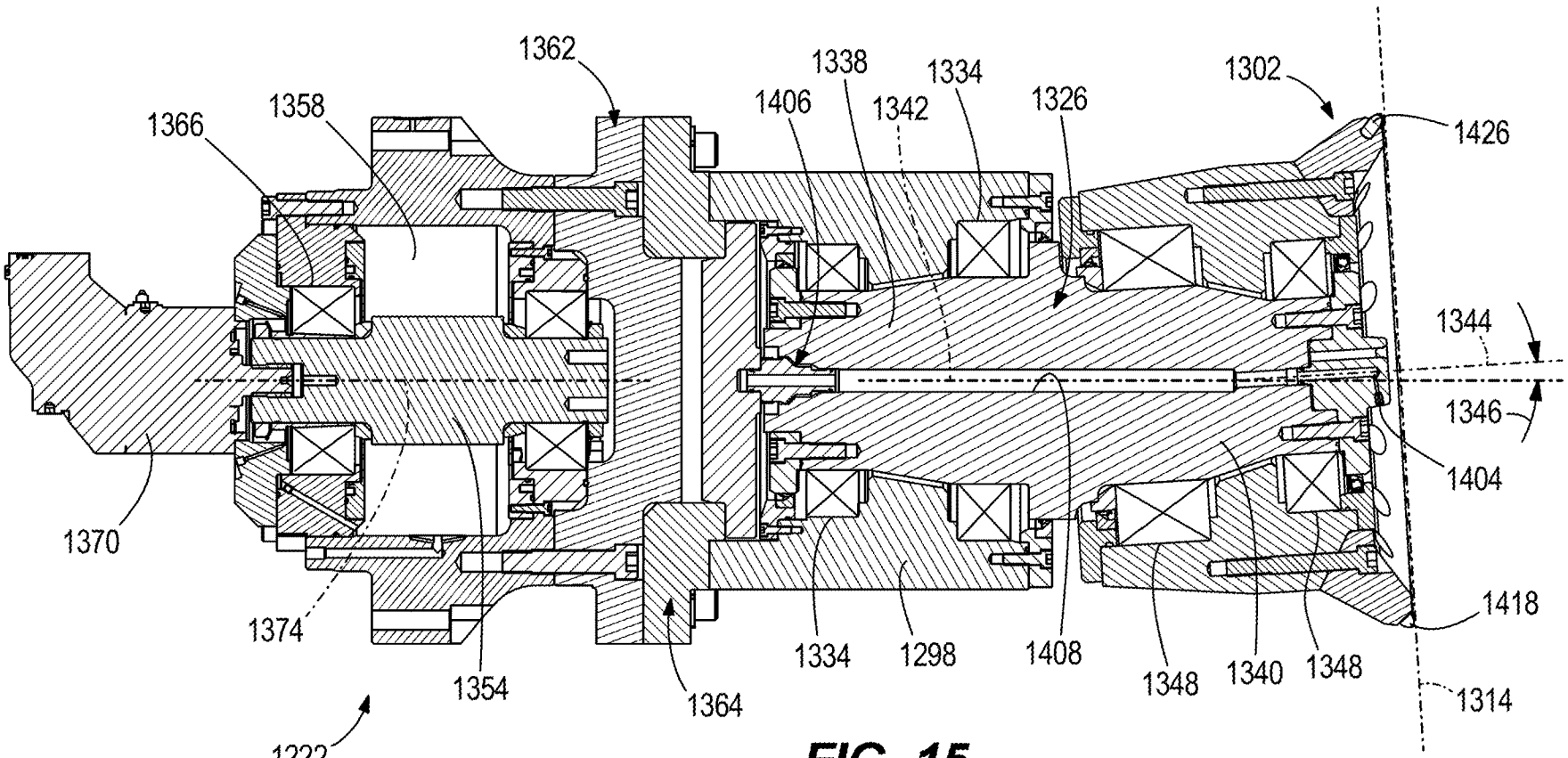
FIG. 15 is a side cross-section view of the cutter head of FIG. 12, viewed along section 15-15.

FIGS. 14 and 15 illustrate a cutter head 1222 according to still another embodiment. Many aspects of the cutter head 1222 are similar to the cutter head 22, and similar features are identified with similar reference numbers, plus 1200.

As shown in FIG. 15, the cutter head 1222 includes a single motor 1370 for driving an exciter shaft 1354 to rotate an eccentric mass 1358 about an exciter axis 1374. In cutter head 1222 further includes a shaft 1326 supporting a cutting disc 1302. In particular, the shaft 1326 includes a first portion 1338 and a second portion 1340. The first portion 1338 is supported for rotation (e.g., by shaft bearings 1334) relative to a housing 1298. The first portion 1338 extends along a first axis 1342, and the second portion 1340 extends along a second axis 1344 that is oblique or non-parallel relative to the first axis 1342. In the illustrated embodiment, the second axis 1344 forms an acute angle 1346 relative to the first axis 1342. The cutting disc 1302 is coupled to a carrier 1322 that is supported for rotation on the second portion 1340. In the illustrated embodiment, the carrier 1322 is not directly driven to rotate but is supported for free rotation relative to the second portion 1340 (e.g., by carrier bearings 1348).

In the illustrated embodiment, the housing 1298 may be coupled to an exciter case 1362 (e.g., by an adaptor plate 1364), but the first portion 1338 of the shaft 1326 (e.g., a first end or proximate end of the shaft 1326) is not directly secured for rotation with the exciter case 1362. The shaft 1326 is not directly driven to rotate but instead is supported for free rotation relative to the housing 1298 and relative to the exciter case 1362. In the illustrated embodiment, the shaft 1326 rotates about an axis (e.g., the first axis 1342) that is concentric with the exciter axis 1374. In other embodiments, the axis of rotation of the shaft 1326 may be offset and/or inclined relative to the exciter axis 1374. Also, in the illustrated embodiment, the combined center of gravity of the second portion 1340 of the shaft 1326 and the components supported thereon (e.g., the cutting disc 1302, the carrier 1322, the carrier bearings 1348, etc.) lie on an axis that is concentric with the first axis 1342.

Figure 16:
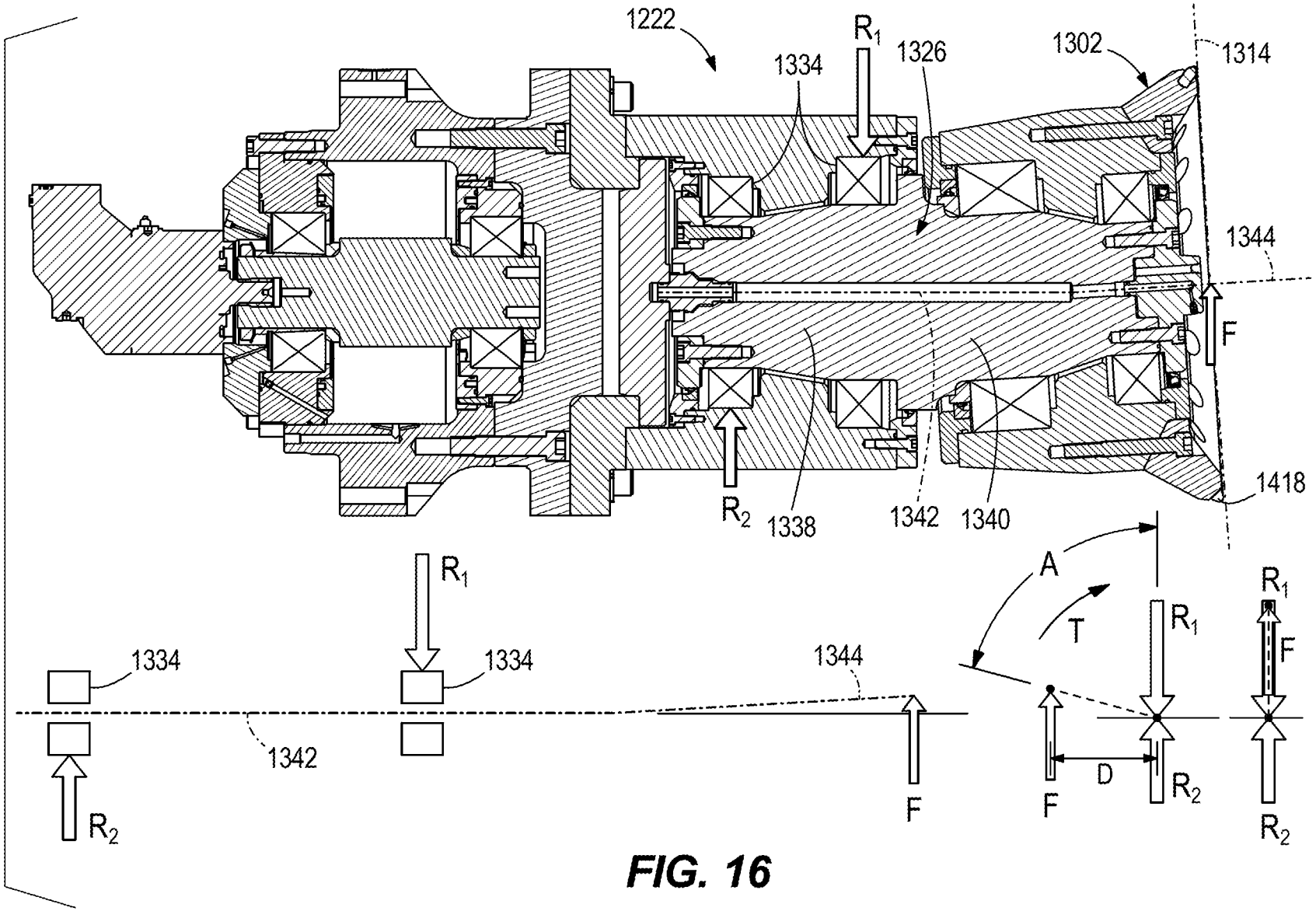
FIG. 16 is a side cross-section view of the cutter head of FIG. 12, viewed along section 15-15.

The cutter head 1222 does not include a second motor for driving rotation of the shaft 1326. The portion of the shaft 1326 supporting the cutting disc 1302 (i.e., the second portion 1340) is oblique or non-parallel relative to the first portion 1338. As shown in FIG. 16, because the cutting disc 1302 is free to rotate about the second axis 1344, a radial component of the cutting reaction force F acts on the second portion 1340 at the point where the second axis 1344 intersects a cutting plane 1314 of the disc 1302. As a result, any radial load applied to the cutting disc 1302, such as the reaction forces caused by the impact of the cutting disc 1302 against a rock formation, will create a moment on the shaft 1326 and cause the shaft 1326 to rotate about the first axis 1342 so that the second portion 1340 is oriented away from the applied force. The magnitude of the moment is equal to the radial component of the cutting force F multiplied by a distance D between the line of action of the cutting force F (i.e., the intersection of the second axis 1344 with the cutting plane 1314) and the intersection of the first axis 1342 with the cutting plane 1314. The product of the radial component and the distance D creates a steering torque T. The leading portion 1418 of the cutting disc 1302 (i.e., the portion of the disc 1302 that protrudes the furthest in a direction parallel to the first axis 1342) is therefore automatically oriented to engage the rock, even if the direction of travel of the cutter head 1222 is changed. It is understood that the radial component of the reaction force may not be precisely aligned with the travel direction at all times, but the two will be substantially aligned. It is also possible that the shaft bearings 1334 may generate some friction to resist small changes in the direction of travel. The shaft bearings 1334 also exert reaction forces R1, R2 on the shaft 1326 in response to the cutting force F.

Referring again to FIG. 15, the cutter head 1222 further includes one or more spray nozzles 1404, a fluid swivel 1406, and a fluid passage 1408 extending through the shaft 1326. In the illustrated embodiment, the fluid swivel 1406 receives a spray fluid, such as water, from a fluid source (e.g., a pump—not shown). The fluid passage 1408 provides fluid communication between the swivel 1406 and the spray nozzle 1404 positioned on the shaft 1326 adjacent the cutting disc 1302. Pressurized fluid is sprayed from the nozzle 1404. In the illustrated embodiment, the nozzle 1404 is secured to an end of the shaft 1326 and oriented toward the leading portion 1418 of the disc 1302. As the shaft 1326 rotates, the nozzle 1404 will maintain its orientation to emit fluid toward the direction of impact.

The cutter head 1222 avoids the need for a second motor and the accompanying hydraulic components, and also includes simple mechanical components to achieve a "steering" function. In addition, a smaller diameter cutting disc 1302 can be used, and the control of the boom (FIG. 1) supporting the cutter head 1222 is less complex.

Although cutting devices have been described above with respect to a mining machine (e.g., an entry development machine), it is understood that one or more independent aspects of the cutting devices and/or other components may be incorporated into another type of machine and/or may be supported on a boom of another type of machine. Examples of other types of machines may include (but are not limited to) drills, road headers, tunneling or boring machines, continuous mining machines, longwall mining machines, and excavators.

Although various aspects have been described in detail with reference to certain embodiments, variations and modifications exist within the scope and spirit of one or more independent aspects as described. Various features and advantages are set forth in the following claims.

What is claimed is:

1. A rock excavating device comprising:

a shaft including a first portion and a second portion connected to an end of the first portion, the first portion supported for rotation about a first axis, the second portion extending along a second axis that is oblique with respect to the first axis;

a cutting element supported on the second portion of the shaft and rotatable about the second axis, the cutting element including a cutting edge having a leading portion and a trailing portion, the cutting edge rotatable in a rotation plane perpendicular to the second axis, the leading portion configured to engage a rock surface, the trailing portion configured to be spaced apart from the rock surface, rotation of the first portion of the shaft about the first axis changing the orientation of the second axis and the orientation of the leading portion, the cutting element being a cutting disc and the cutting edge having a round shape, the first axis and the second axis intersecting one another at a center of a plane formed by a plurality of cutting bits; and an eccentric mass positioned adjacent the first portion of the shaft, the eccentric mass driven to rotate about an exciter axis, rotation of the eccentric mass inducing an oscillation of the shaft and the cutting element.

2. The rock excavating device of claim 1, further comprising a motor for driving the first portion to rotate about the first axis.

3. The rock excavating device of claim 1, further comprising:

a first motor for driving rotation of the eccentric mass; and a second motor for driving the first portion to rotate about the first axis.

4. The rock excavating device of claim 1, wherein the first axis and the second axis lie in a common plane, the common plane aligned with a cutting direction of the cutting element.

5. The rock excavating device of claim 4, wherein the trailing portion is spaced apart from the leading portion, the common plane extending between the leading portion and the trailing portion.

6. The rock excavating device of claim 1, wherein the second portion of the shaft includes an end adjacent the cutting edge and spaced apart from the first axis, the rock excavating device further comprising at least one fluid nozzle secured to the end of the second portion and oriented toward the first axis.

7. The rock excavating device of claim 1, wherein a combined center of gravity of the second portion and components supported thereon is concentric with the first axis.

8. The rock excavating device of claim 1, wherein the cutting element is supported for free rotation relative to the second portion.

9. The rock excavating device of claim 1, wherein reaction forces exerted on the cutting edge due to impact with a rock surface are configured to induce a moment driving rotation of the first portion of the shaft about the first axis, thereby re-orienting the leading portion of the cutting edge to engage the rock surface.

10. A cutting assembly for a rock excavation machine, the cutting assembly comprising:

a boom; and a cutting device supported on the boom, the cutting device including, a shaft including a first portion and a second portion connected to an end of the first portion, the first portion supported for rotation about a first axis, the second portion extending along a second axis that is oblique with respect to the first axis, a cutting element supported on the second portion of the shaft and rotatable about the second axis, the cutting element including a cutting edge having a leading portion and a trailing portion, the cutting edge rotatable in a rotation plane perpendicular to the second axis, the leading portion configured to engage a rock surface, the trailing portion configured to be spaced apart from the rock surface, rotation of the first portion of the shaft about the first axis changing the orientation of the second axis and the orientation of the leading portion, and an eccentric mass positioned adjacent the first portion of the shaft, the eccentric mass driven to rotate about an exciter axis, rotation of the eccentric mass inducing an oscillation of the shaft and the cutting element, wherein the cutting element is a cutting disc and the cutting edge has a round shape, wherein the first axis and the second axis intersect one another at a center of a plane formed by a plurality of cutting bits.

11. The cutting assembly of claim 10, wherein the first axis and the second axis lie in a common plane, the common plane aligned with a cutting direction of the cutting element.

12. The cutting assembly of claim 11, wherein the trailing portion is spaced apart from the leading portion, the common plane extending between the leading portion and the trailing portion.

13. The cutting assembly of claim 10, further comprising a suspension device for resiliently supporting the cutting device for oscillating movement relative to the boom.

14. The cutting assembly of claim 13, wherein the suspension device includes at least one fluid cylinder for biasing the cutting device in a predetermined direction relative to the boom.

15. The cutting assembly of claim 10, further comprising a motor for driving the first portion to rotate about the first axis.

16. The cutting assembly of claim 10, further comprising:

a first motor for driving rotation of the eccentric mass; and a second motor for driving the first portion to rotate about the first axis.

17. The cutting assembly of claim 10, wherein the cutting element is supported for free rotation relative to the second portion.

18. The cutting assembly of claim 10, wherein reaction forces exerted on the cutting edge due to impact with a rock surface are configured to induce a moment driving rotation of the first portion of the shaft about the first axis, thereby re-orienting the leading portion of the cutting edge to engage the rock surface.

19. A rock excavating device comprising:

a shaft including a first portion and a second portion connected to an end of the first portion, the first portion supported for rotation about a first axis, the second portion extending along a second axis that is oblique with respect to the first axis;

a cutting element supported on the second portion of the shaft and rotatable about the second axis, the cutting element including a cutting edge having a leading portion and a trailing portion, the cutting edge rotatable in a rotation plane perpendicular to the second axis, the leading portion configured to engage a rock surface, the trailing portion configured to be spaced apart from the rock surface, rotation of the first portion of the shaft about the first axis changing the orientation of the second axis and the orientation of the leading portion; and an eccentric mass positioned adjacent the first portion of the shaft, the eccentric mass driven to rotate about an exciter axis, rotation of the eccentric mass inducing an oscillation of the shaft and the cutting element, wherein reaction forces exerted on the cutting edge due to impact with a rock surface are configured to induce a moment driving rotation of the first portion of the shaft about the first axis, thereby re-orienting the leading portion of the cutting edge to engage the rock surface.

20. The rock excavating device of claim 19, further comprising a motor for driving rotation of the eccentric mass.

21. The rock excavating device of claim 19, wherein the first axis and the second axis lie in a common plane, the common plane aligned with a cutting direction of the cutting element.

22. The rock excavating device of claim 21, wherein the trailing portion is spaced apart from the leading portion, the common plane extending between the leading portion and the trailing portion.

23. The rock excavating device of claim 19, wherein the second portion of the shaft includes an end adjacent the cutting edge and spaced apart from the first axis, the rock excavating device further comprising at least one fluid nozzle secured to the end of the second portion and oriented toward the first axis.

24. The rock excavating device of claim 19, wherein a combined center of gravity of the second portion and components supported thereon is concentric with the first axis.

25. The rock excavating device of claim 19, wherein the cutting element is supported for free rotation relative to the second portion.

* * * * *